US009206732B2

(12) United States Patent
Cattani et al.

(10) Patent No.: US 9,206,732 B2
(45) Date of Patent: Dec. 8, 2015

(54) EXHAUST PULSE ENERGY DIVIDER

(75) Inventors: Luis C Cattani, Aurora, IL (US); Michael D Bartkowicz, Oswego, IL (US); Jim Burke, Naperville, IL (US); Paul Gottemoller, Palos Park, IL (US); John Zagone, Westmont, IL (US)

(73) Assignee: International Engine Intellectual Property Company, LLC, Lisle, IL (US)

( * ) Notice: Subject to any disclaimer, the term of this patent is extended or adjusted under 35 U.S.C. 154(b) by 499 days.

(21) Appl. No.: 13/636,943

(22) PCT Filed: Feb. 24, 2011

(86) PCT No.: PCT/US2011/026028

§ 371 (c)(1),
(2), (4) Date: Mar. 14, 2013

(87) PCT Pub. No.: WO2011/106496

PCT Pub. Date: Sep. 1, 2011

(65) Prior Publication Data

US 2013/0167527 A1 Jul. 4, 2013

Related U.S. Application Data

(60) Provisional application No. 61/308,349, filed on Feb. 26, 2010.

(51) Int. Cl.

| | |
|---|---|
| ***F02D 23/00*** | (2006.01) |
| ***F02B 27/04*** | (2006.01) |
| ***F01D 9/02*** | (2006.01) |
| ***F01D 17/10*** | (2006.01) |
| *F02B 37/18* | (2006.01) |

(52) U.S. Cl.

CPC ..... *F02B 27/04* (2013.01); *F01D 9/026* (2013.01); *F01D 17/105* (2013.01); *F02B 37/183* (2013.01); *F02B 37/18* (2013.01); *F05D 2220/40* (2013.01); *F05D 2240/12* (2013.01); *Y10T 137/0536* (2015.04)

(58) Field of Classification Search

CPC ..... Y02T 10/144; F02B 37/025; F02B 37/22; F02B 37/225; F01D 9/026; F01D 17/105

USPC ..... 60/602, 615, 605.1, 280; 123/568.17, 123/65 E; 415/205, 211.1, 184, 151

See application file for complete search history.

(56) References Cited

U.S. PATENT DOCUMENTS

| | | | | |
|---|---|---|---|---|
| 3,423,926 | A * | 1/1969 | Holzhausen et al. | 60/615 |
| 4,530,640 | A * | 7/1985 | MacInnes | 415/144 |
| 4,565,068 | A * | 1/1986 | Schneider | 60/602 |

(Continued)

*Primary Examiner* — Jesse Bogue
*Assistant Examiner* — Thomas Olszewski
(74) *Attorney, Agent, or Firm* — Jeffrey P. Calfa; Mark C. Bach

(57) ABSTRACT

An exhaust gas turbocharger housing (10) for an engine includes a main turbine housing portion (14) and a throat portion (12) defining an exhaust gas passageway (20) that is in upstream fluid communication with the main turbine housing. The exhaust passageway (20) communicates exhaust gases (EG) to the main turbine housing portion (14). A flow divider (22) generally bisects the exhaust gas passageway (20) forming a first inlet passageway (24A) and a second inlet passageway (24B). A flow hole (26) is disposed through the flow divider (22) for permitting the fluid communication of exhaust gas (EG) from the first inlet passageway (24A) to the second inlet passageway (24B).

8 Claims, 1 Drawing Sheet

(56) References Cited

U.S. PATENT DOCUMENTS

| | | | | |
|---|---|---|---|---|
| 4,776,168 | A * | 10/1988 | Woollenweber | 60/602 |
| 5,487,273 | A * | 1/1996 | Elpern et al. | 60/602 |
| 5,819,693 | A * | 10/1998 | Curtil | 123/65 E |
| 7,004,406 | B2 | 2/2006 | Yang | |
| 2004/0050973 | A1 | 3/2004 | Yang | |
| 2008/0290188 | A1 | 11/2008 | Zukouski | |
| 2010/0155510 | A1 | 6/2010 | Bamber | |
| 2010/0266390 | A1 * | 10/2010 | Henderson et al. | 415/151 |
| 2011/0030635 | A1 | 2/2011 | Siuchta | |
| 2011/0192375 | A1 | 8/2011 | Siuchta | |

* cited by examiner

EXHAUST PULSE ENERGY DIVIDER

BACKGROUND

Embodiments described herein relate to an exhaust gas flow divider for a turbocharger turbine housing.

Back pressure developed by exhaust gases can be used to develop a retarding force on an engine, known as engine braking. The exhaust gas back pressure can be developed at a turbocharger located downstream of the engine.

With an inline six-cylinder engine having a front exhaust manifold divided from a rear exhaust manifold, the exhaust gases from the front three cylinders are isolated from the rear three cylinders. The exhaust gas exits both of the front and the rear exhaust manifolds into a turbocharger turbine inlet. The turbocharger turbine inlet may be a single, open channel, which allows the exhaust gases from the front and the rear exhaust manifolds to communicate. This communication of the exhaust gas, known as a "short circuit", reduces the exhaust pulse energy and reduces the exhaust back pressure, reducing the engine braking power.

EGR systems also use exhaust back pressure to drive exhaust gas flow through the EGR system. However, as discussed above, an open turbocharger turbine inlet reduces the exhaust back pressure, which also reduces the drive of exhaust gas flow through the EGR system.

To address the reduced exhaust back pressure of an open turbocharger turbine inlet, a fully divided turbocharger turbine may be used. The divided turbocharger turbine has two isolated channels that prevent the communication of the exhaust gas from the front and rear engine cylinders. Wastegates are typically employed on turbochargers to regulate and protect the engine and turbocharger from excess boost pressure. In a fully divided turbocharger, typically there are two valves to waste the excess boost pressure instead of the one valve that is used in the open turbocharger. The fully divided turbocharger is also more expensive to develop and manufacture than the open turbocharger.

SUMMARY

An exhaust gas turbocharger housing for an engine includes a main turbine housing portion and a throat portion defining an exhaust gas passageway that is in upstream fluid communication with the main turbine housing. The exhaust passageway communicates exhaust gases to the main turbine housing portion. A flow divider generally bisects the exhaust gas passageway forming a first inlet passageway and a second inlet passageway. A flow hole is disposed through the flow divider for permitting the fluid communication of exhaust gas from the first inlet passageway to the second inlet passageway.

Another exhaust gas turbocharger housing for an engine includes a main turbine housing portion and a throat portion that defines an exhaust gas passageway. The exhaust passageway is in upstream fluid communication with the main turbine housing for communicating exhaust gases to the main turbine housing portion. A wastegate port is disposed on the throat portion and is in fluid communication with the exhaust gas passageway. At least one flow divider divides the exhaust gas passageway into a plurality of inlet passageways. At least one flow hole is disposed through the at least one flow divider for permitting the fluid communication of exhaust gas between the plurality of inlet passageways.

A method of wasting exhaust gas in a throat portion of a turbocharger turbine housing, where the throat portion defines an exhaust gas passageway for the fluid communication of exhaust gas from an engine to a main turbine housing portion, includes the step of providing a wastegate port in the throat portion. The method further includes the steps of dividing the exhaust gas passageway into a first inlet passageway and a second inlet passageway with a flow divider having a flow opening permitting the fluid communication between the two inlet passageways, and opening the wastegate port disposed either the first inlet passageway or the second inlet passageway. The method further includes wasting exhaust gas from both the first inlet passageway and the second inlet passageway, where at least a portion of the exhaust gas flows through the flow opening to the wastegate port.

DETAILED DESCRIPTION

Figure 1:
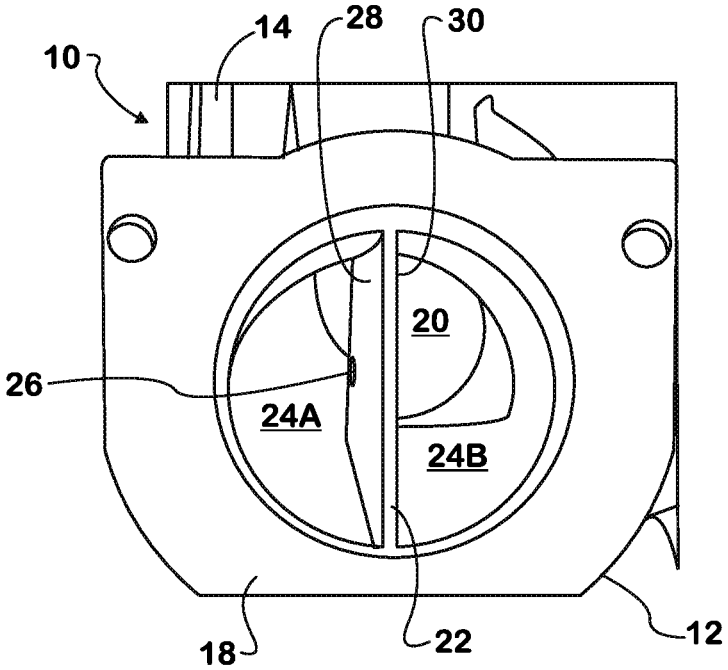
FIG. 1 is a front view of an exhaust gas flow divider disposed in a turbocharger turbine housing.
Figure 2:
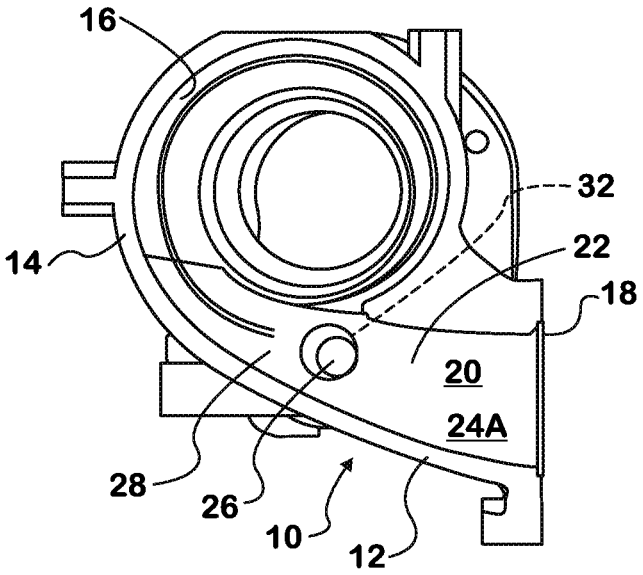
FIG. 2 is a cross-section of the turbocharger turbine housing having the flow divider upstream of the turbine.

Referring to FIGS. 1-2, a turbocharger turbine housing is indicated generally at 10 and includes a throat portion 12 extending upstream from a main turbine housing portion 14. The main turbine housing portion 14 is generally cylindrical and is configured to house a turbine wheel that receives a flow of exhaust gas EG from the throat portion 12. The main turbine housing portion 14 may have a generally cylindrical interior surface 16. The throat portion 12 may be a generally curved or spiral-shaped inlet duct, however other shapes are possible.

An inlet surface 18 of the throat portion 12 is configured to be attached to an engine (not shown). The throat portion 12 may be generally cylindrical or circular in cross-section and extends from the inlet surface 18 to the main turbine housing portion 14. The throat portion 12 defines an exhaust gas passageway 20 for the flow of exhaust gas from the engine, through the throat portion, and to the turbine housing portion 14. The exhaust gas passageway 20 is in fluid communication with the interior surface 16 of the main turbine housing portion 14. The inlet surface 18 is generally transverse to the exhaust gas passageway 20.

A flow divider 22 is disposed inside the throat portion 12 and divides the exhaust gas passageway 20 into two generally equally sized inlet passageways 24A, 24B, although other sizes of passageways are possible. The inlet passageways 24A, 24B may have a generally half-cylinder shape, however other shapes are possible. Further, it is possible that multiple flow dividers 22 may divide the exhaust passageway 20 into any number of inlet passageways 24.

The flow divider 22 has a height that generally bisects the exhaust gas passageway 20 along the length of the passageway, however it is possible that the flow divider 22 can have other heights. The flow divider 22 may be flush with the inlet surface 18, or alternately, may be offset from the inlet surface. As seen in FIG. 2, the flow divider 22 may extend generally from the inlet surface 18 to the main turbine housing portion 14, although other lengths are possible. The length of the flow divider 22, and the length of the inlet passageways 24A, 24B formed by the flow divider, are sufficient to direct the exhaust gas EG to the main turbine housing portion 14 so that the exhaust gas does not short circuit back to either the front or the rear exhaust manifold (not shown), whichever of the two exhaust manifolds is the opposite manifold from which the exhaust gas was emitted. The flow divider 22 may be cast with the throat portion 12 and the inlet surface 18, however other mechanical attachments are possible.

A flow hole 26 is disposed through the flow divider 22 from a first surface 28 defining the inlet passageway 24A to a second surface 30 defining the inlet passageway 24B. The flow hole 26 provides fluid communication for exhaust gas between the inlet passageway 24A and the inlet passageway 24B. The flow hole 26 may be located generally centrally along the length of the flow divider 22, however other locations are possible. It is possible that multiple flow holes 26 may be disposed through the flow divider 22.

A wastegate port 32 (shown in dashed) is disposed through the turbocharger housing 10 on the side of inlet passageway 24B, however the wastegate port may be formed through the turbocharger housing on either side of the flow divider 22. The flow hole 26 may be located generally on center with the wastegate port 32, however it is possible that the flow hole 26 and the wastegate port are not aligned. In an on center configuration, both the flow hole 26 and the wastegate port 32 have axes that are generally transverse to the exhaust gas passageway 20, and at least a portion of the flow hole overlaps the wastegate port (see FIG. 2). It is possible that the flow hole 26 does not overlap with the wastegate port 32, but are instead offset from each other along the length of the exhaust gas passageway 20. Further, while the flow hole 26 may be circular, other shapes are possible.

The wastegate port 32 permits a wastegate valve (not shown) to divert exhaust gases EG from the throat portion 12, away from the main turbine housing portion 14, regulating the turbine speed, which in turn regulates the rotating speed of a compressor. The wastegate port 32 allows the regulation of the maximum boost pressure to protect the engine and the turbocharger. The flow hole 26 may be located in the general proximity of the wastegate port 32 a distance that allows the exhaust gas EG to be diverted from the inlet passageway 24A when the wastegate valve is opened.

When the wastegate valve is actuated, at least a portion of the flow of the exhaust gas EG flows through the flow hole 26 from the inlet passageway 24A to the inlet passageway 24B, and out of the throat portion 12 through the wastegate port 32. Alternately, with a wastegate port located in inlet passageway 24A, the exhaust gas EG would flow through the flow hole 26 from the inlet passageway 24B to the inlet passageway 24A, and out through the wastegate port. In both configurations, excess exhaust gas EG from both inlet passageways 24A, 24B are wasted through the wastegate port 32, and can either be fed into the exhaust system or can be vented to the atmosphere.

The turbine turbocharger housing 10 having the flow divider 22 provides greater back pressure and greater exhaust pulse energy for low speed EGR performance than an open turbine housing design. Further, the flow divider 22 having the flow hole 26 allows a single wastegate port 28 and wastegate valve to service both of the inlet passageways 24A, 24B. Further, the flow divider 22 may be more easily cast than a conventional divided turbocharger turbine housing 10.

What is claimed is:

1. An exhaust gas turbocharger housing for an engine, comprising:

an undivided main turbine housing portion;

a throat portion defining an exhaust gas passageway in upstream fluid communication with the undivided main turbine housing for communicating exhaust gases to the undivided main turbine housing portion;

a flow divider disposed within the throat portion, which flow divider does not extend into the main turbine housing and which generally bisects the exhaust gas passageway forming a first inlet passageway and a second inlet passageway for communicating exhaust gases to the undivided main turbine housing;

a flow hole through the flow divider for permitting the fluid communication of exhaust gas from the first inlet passageway to the second inlet passageway; and a single wastegate disposed on one of the first or second inlet passageways and in fluid communication with the atmosphere and one of the first or second inlet passageways.

2. The housing of claim 1 further comprising an inlet surface of the throat portion that is generally transverse to the exhaust gas passageway.

3. The housing of claim 2 wherein the flow divider is generally flush with the inlet surface.

4. A method of wasting exhaust gas in a throat portion of a turbocharger turbine housing, the throat portion defining an exhaust gas passageway for the fluid communication of exhaust gas from an engine to an undivided main turbine housing portion, the method comprising the steps of:

dividing the exhaust gas passageway into a first inlet passageway and a second inlet passageway with a flow divider having a flow opening permitting the fluid communication between the two inlet passageways;

providing a wastegate port in one of the first inlet passageway or the second inlet passageway of the throat portion;

opening the wastegate port disposed in one of the first inlet passageway and the second inlet passageway; and wasting exhaust gas from both the first inlet passageway and the second inlet passageway, wherein at least a portion of the exhaust gas flows through the flow opening to the wastegate port.

5. The method of claim 4 further comprising providing a single wastegate port on the throat portion.

6. The method of claim 4 further comprising the step of generally aligning the flow opening and the wastegate port along the length of the flow divider.

7. The method of claim 4 further comprising extending the flow divider from an inlet surface of the throat portion, wherein the inlet surface is generally transverse to the exhaust passageway.

8. The method of claim 4 further comprising extending the flow divider to the main turbine housing portion.

* * * * *